US008955889B2

(12) United States Patent
Bendel et al.

(10) Patent No.: US 8,955,889 B2
(45) Date of Patent: Feb. 17, 2015

(54) MOTOR VEHICLE LOCK WITH A SELF-LOCKING MECHANISM

(75) Inventors: Thorsten Bendel, Oberhausen (DE); Karsten Barth, Hattingen (DE); Serkan Gülkan, Hattingen (DE); Ulrich Weichsel, Duisburg (DE); Claus Töpfer, Sindelfingen (DE)

(73) Assignee: Kiekert AG, Heiligenhaus (DE)

( * ) Notice: Subject to any disclaimer, the term of this patent is extended or adjusted under 35 U.S.C. 154(b) by 234 days.

(21) Appl. No.: 13/322,233

(22) PCT Filed: Jun. 11, 2010

(86) PCT No.: PCT/DE2010/000657

§ 371 (c)(1), (2), (4) Date: Nov. 23, 2011

(87) PCT Pub. No.: WO2010/142280

PCT Pub. Date: Dec. 16, 2010

(65) Prior Publication Data

US 2012/0068479 A1 Mar. 22, 2012

(30) Foreign Application Priority Data

Jun. 12, 2009 (DE) ..... 10 2009 026 921

(51) Int. Cl.
*E05C 3/04* (2006.01)
*E05B 85/26* (2014.01)
*E05B 81/20* (2014.01)
(Continued)

(52) U.S. Cl.
CPC ..... *E05B 85/26* (2013.01); *E05B 81/20* (2013.01); *E05B 81/68* (2013.01); *Y10S 292/23* (2013.01)
USPC ..... 292/200; 292/201; 292/216; 292/DIG. 23

(58) Field of Classification Search
CPC ..... E05B 17/0045; E05B 2015/1685; E05B 85/26
USPC ..... 292/198, 200, 201, 216, 217, DIG. 23
See application file for complete search history.

(56) References Cited

U.S. PATENT DOCUMENTS 5,288,115 A 2/1994 Inoue et al.
5,427,421 A * 6/1995 Hamaguchi ..... 292/216
(Continued)

FOREIGN PATENT DOCUMENTS

DE 199 05 774 A1 8/2000
DE 19902561 A1 * 8/2000
(Continued)

*Primary Examiner* — Kristina Fulton
*Assistant Examiner* — Faria Ahmad
(74) *Attorney, Agent, or Firm* — Renner, Otto, Boisselle & Sklar, LLP

(57) ABSTRACT

The invention relates to a lock for a motor vehicle with a locking mechanism including a catch and a pawl. The object of the invention is to simplify the locking of a lock of the type mentioned above. To achieve the object of the invention, a catch of the claimed lock comprises a stop projecting upwards, e.g., in the form of a pin extending from the catch. Furthermore, a bracket is provided, which can be moved against the stop by means of a motor such that the catch is moved in this way from the first position and into the primary position. It is thus possible to move from the first position to the primary position in a motorized manner, which makes it easier to close the vehicle door.

14 Claims, 4 Drawing Sheets

(51) Int. Cl.

| | |
|---|---|
| *E05C 3/06* | (2006.01) |
| *E05C 3/16* | (2006.01) |
| *E05B 81/68* | (2014.01) |

(56) References Cited

U.S. PATENT DOCUMENTS

| | | | | |
|---|---|---|---|---|
| 5,438,855 | A * | 8/1995 | Ikeda | 70/279.1 |
| 5,516,164 | A * | 5/1996 | Kobayashi | 292/201 |
| 5,802,894 | A * | 9/1998 | Jahrsetz et al. | 70/264 |
| 5,865,481 | A * | 2/1999 | Buschmann | 292/216 |
| 5,938,251 | A * | 8/1999 | Watanabe | 292/201 |
| 6,382,687 | B1 * | 5/2002 | Gruhn | 292/201 |
| 6,848,727 | B1 * | 2/2005 | Cetnar et al. | 292/201 |
| 7,210,714 | B2 * | 5/2007 | Berghahn et al. | 292/201 |
| 7,475,922 | B2 * | 1/2009 | Ottino et al. | 292/216 |
| 8,267,444 | B2 * | 9/2012 | Akizuki et al. | 292/201 |
| 8,282,141 | B2 * | 10/2012 | Paing et al. | 292/216 |
| 8,474,888 | B2 * | 7/2013 | Tomaszewski | 292/201 |
| 2010/0052336 | A1 * | 3/2010 | Bendel et al. | 292/196 |
| 2011/0127780 | A1 * | 6/2011 | Barth et al. | 292/213 |

FOREIGN PATENT DOCUMENTS

| | | | |
|---|---|---|---|
| DE | 10 2007 003 948 | A1 | 5/2008 |
| DE | 102007003948 | A1 * | 5/2008 |
| EP | 1 243 725 | A2 | 9/2002 |

* cited by examiner

MOTOR VEHICLE LOCK WITH A SELF-LOCKING MECHANISM

CROSS-REFERENCE TO RELATED APPLICATIONS

This is a National Stage Application of International Patent Application No. PCT/DE2010/000657, with an international filing date of Jun. 11, 2010, which is based on German Patent Application No. 10 2009 026 921.5, filed Jun. 12, 2009.

BACKGROUND OF THE INVENTION

1. Field of the Invention

The invention relates to a lock for a motor vehicle with a locking mechanism comprising a catch and a pawl with which the catch can be locked in a closed position. The invention relates, in particular, to a lock with a pawl for engaging in a primary position (hereafter referred to as the "primary-position pawl"), and a pawl for engaging in a first position (hereafter referred to as the "first-position pawl") and a blocking lever for engaging said primary-position pawl. Such a lock is known from DE 10 2007 003 948 A1.

2. Brief Description of the Related Art

The catch of a motor vehicle lock has a fork-shaped inlet slot into which a locking pin attached to a vehicle door or hatch enters when the vehicle door or hatch is closed. The locking pin then rotates the catch from an open position to a closed position. When the catch reaches the closed position, the locking pin can no longer leave the inlet slot of the catch. In the closed position, the pawl locks the catch such that the catch cannot be rotated back into the open position.

Frequently, a motor vehicle lock has two closed positions, which are taken up consecutively during the closing process of the catch, namely the so-called first position and the so-called primary position.

To prevent the pawl from leaving its locked position unexpectedly, a blocking lever can be provided to block such movement when the catch is locked. Such a blocking lever is necessary for the primary-position pawl of the lock described in DE 10 2007 003 948 A1 because the catch and the primary-position pawl are constructed such that the pawl assuming the primary position pushes the primary-position pawl out of the latched position.

The rotatably arranged blocking lever, known from DE 10 2007 003 948 A1, is biased by a spring. Because of this bias, when the catch is not in the primary position, the blocking lever exerts pressure on the primary-position pawl in the direction toward the catch. This pressure is responsible for ensuring that the primary-position pawl is moved into its locked position when the catch reaches the primary position. The bias then further ensures that the blocking lever is ultimately moved into the blocking position so that the vehicle door or hatch closes completely.

To unlock the lock, the blocking lever is rotated, with the help of the first-position pawl, against the biasing force until the blocking lever sets free the primary-position pawl. The primary-position pawl is then pushed by the catch from the locked position or is stricken by a driver of the first-position pawl, and in this way is moved out of the locked position. Subsequently, the catch rotates into the open position from the primary position due to a commensurate bias. The locking pin can then move out of the inlet slot, and the attached vehicle door or hatch can be pushed ajar.

BRIEF DESCRIPTION OF THE INVENTION

The object of the invention is to simplify the opening of a lock of the type mentioned above.

The object of the invention is achieved by providing a lock having the characteristics of the first claim. Advantageous embodiments are described in the dependent claims.

To achieve the object of the invention, the catch of the claimed lock comprises an upwardly projecting stop, which, for example, takes the form of a pin rising above the catch. Furthermore, a bracket is provided, which can be moved against the stop by means of a motor such that the catch is moved in this way from the first position and into the primary position. It is thus possible, to move from the first position to the primary position in a motorized manner, which makes it easier to close the vehicle door. The stop acts at the same time as a stop for the pawl. In this way the number of required components is also kept to a minimum.

In one embodiment of the invention, the stop also serves as a stop for the first-position pawl, which thereby locks the catch in this position. In this embodiment, there is also no need for an additional stop for locking the catch using the first-position pawl.

In one embodiment of the invention, the bracket is disposed above the first-position pawl seen from the wall of the housing on which the catch is pivotally mounted. In this way, it is structurally possible to use a pin having a thin diameter, both as a stop for the bracket as well as a stop for the first-position pawl.

In one embodiment of the invention, provided is a guide that guides the locking pin relative to the position of the first-position pawl. On the one hand, the bracket is drawn hereby against the stop. On the other hand, it is possible by the movement of the first-position pawl to redirect the movement of the bracket such that the bracket is not moved against the stop. It is possible to prevent, for example during an emergency, the automatic closing of the door from the first position to the primary position through the movement of the first-position pawl. When the first-position pawl is moved, the locking of the catch by the first-position pawl is also unlocked, simultaneously, and the door or hatch can be opened immediately. Such an emergency can arise, in particular, when a finger is jammed in a door or hatch.

In one embodiment of the invention, the bracket is first guided on an essentially straight line until the bracket has reached the stop. Then, the guide runs in an arcuate configuration such that the bracket can follow the rotational movement of the catch.

In one embodiment of the invention, the catch is connected to microswitches that read the position of the first-position pawl and the primary-position pawl. In this way, the motor-driven movement of the bracket against the stop may be controlled in order to move the catch from the first position to the primary position.

DETAILED DESCRIPTION OF THE INVENTION

An exemplary embodiment of the invention shown in the figures will be explained hereinbelow in more detail. Advantages of further embodiments of the invention will be illustrated with reference to the exemplary embodiment.

Figure 1:
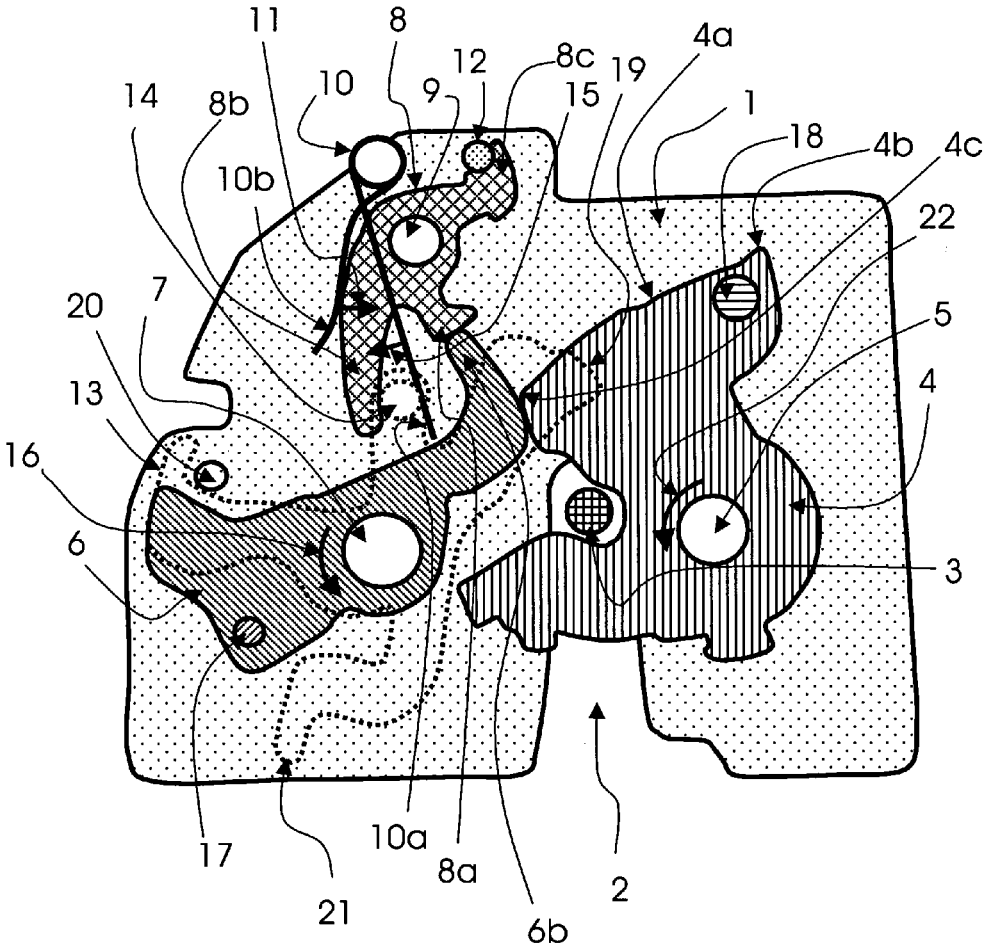
FIG. 1. shows a closed position of a lock with the first-position pawl shown as transparent.

FIG. 1 shows a plan view of a housing wall 1 of a vehicle lock. The housing wall 1 is provided with an inlet slot 2, into which a locking pin 3 of a vehicle door or vehicle hatch enters when the corresponding vehicle door or vehicle hatch is closed. The catch 4 is rotatably mounted on the housing wall 1 and can be rotated about its mounting axis 5. FIG. 1 shows the primary position, in which the locking pin 3 located in the inlet slot 2 in the wall housing is enclosed by the inlet slot of the catch such that the locking pin 3 can no longer be moved out of the inlet slot 2 in the wall housing. The corresponding door or hatch of the vehicle is thus closed. It is obvious that the primary position is shown here because in this figure a turning back of the catch according to the arrow direction 22 toward the open position is blocked by the primary-position pawl 6. The primary-position pawl 6 is also mounted on the housing wall 1 and is rotatable about its mounting axis 7. The catch is biased in the direction toward the open position, preferably by a spring (not shown). Because of this tension, the catch presses diagonally against a stop of the primary-position pawl. Pressing along the diagonal direction pushes the primary-position pawl out of the locked position.

If the catch is not biased by a spring, when said vehicle door or hatch is opened, at least the locking pin 3 causes the rotation of the catch 4 toward the open position as indicated by the arrow 22. The associated torque then pushes the primary-position pawl 6 out of the locked position. However, this is prevented in the primary position by the blocking lever 8, as shown, when the vehicle door or hatch is closed. The blocking lever 8 is also mounted on the housing wall 1 and can be rotated about its mounting axis 9. On a lateral contour area of the blocking lever 8 is disposed an arm 10*b* of a spring 10. The spring 10 is pre-tensioned such that the arm 10*b* of the spring 10 presses the blocking lever in the direction toward the shown blocking position (in the direction of arrow 11). The rotational movement of the blocking lever, caused thereby, is limited, as shown, by the stop 12, which is attached to the housing wall 1 in the form of a protruding pin. The stop 12 causes the blocking lever to be oriented always very precisely in the same blocking position, which is particularly important for the proper functioning of the blocking lever. To allow for a low profile, the spring 10 is arranged predominantly laterally next to the blocking lever 8 as well as next to the first-position pawl. Only one arm 10*a* of the spring 10 extends beyond the blocking lever 8.

Above the primary-position pawl 6 is arranged a first-position pawl. The first-position pawl is also pivotally mounted on the shaft 7 and can, therefore, also be rotated about the axis 7. The outline 13 of the first-position pawl is indicated with dots. The first-position pawl 13 comprises a pin 14, which extends down from the first-position pawl in the direction toward the housing wall 1. At this pin 14, which is attached to the first-position pawl, is disposed the other arm 10*a* of the spring 10. The other arm of the spring 10 pushes in the direction toward the pin 14 along the arrow 15. In the primary position, the pin 14 also lies closely against the lateral contour area of the blocking lever 8. When the first-position pawl 13 is turned in the direction of the arrow 16, the pin 14 causes the blocking lever 8 to be rotated out of the blocking position. The spring arm 10*a* can follow the movement of the stop or the pin 14 such that the rotation of the first-position pawl 13 is not hampered by an opposing force, which would otherwise originate from the spring arm 10*b*. This facilitates the rotation of the blocking lever 8 by the first-position pawl 13 out of the blocking position. When the blocking lever 8 is moved from the blocking position, the primary-position pawl 6 is pushed away by the catch from its shown locked position. Additionally or alternatively, the lateral contour area of the first-position pawl 13 strikes a protruding pin 17, which serves as a stop, and which is attached to the primary-position pawl 6. This has the consequence that the primary-position pawl 6 is rotated out of the shown locked position and releases the catch. The catch then pivots in the direction of the arrow 22 toward the open position and finally sets free the locking pin 3. The corresponding door or gate can then be opened.

The first-position pawl 13 can also lock the catch 4 when a protruding pin 18 of the catch 2 strikes against the lateral contour area 19 of the first-position pawl 13 and thus prevents the rotation of the pawl toward the open position in accordance with the arrow 22. The first-position pawl 13 is preferably biased by a spring (not shown) in the direction toward its locked position. A protruding pin 20, which serves as a stop and is secured to the housing wall 1, prevents further rotation of the first-position pawl beyond its locked position.

The primary-position pawl 6 is preferably not directly biased by a spring. The primary-position pawl 6 is instead appropriately rotated alone by other components, and especially particularly by the rotation of the catch 4, the first-position pawl 13 and/or the blocking lever 8, e.g., by the rotation of the blocking lever 8 into the locked position (primary position). The corresponding rotation of the blocking lever is caused by the supplied tension of the spring 10.

In order to move the primary-position pawl with the help of the blocking lever suitably into the locked position, hook-like endings 6*b* and 8*a* have been found to be particularly suitable. The head of the hook 6*b* of the primary-position pawl acts as a stop for the catch. The tip of the hook 6*b* is blocked in the primary position by the head of the hook 8*a*. If the blocking lever 8 is rotated out of the blocking position, then the two hooks 6*b* and 8*a* interlock. The top end 6*b* ultimately pushes the hook 8*a* so far outward that the lever arm 8*b* of the pin 14 is lifted, whereby the bias of spring 10 is increased (see also FIG. 3). The rotation of the first-position pawl 13 is further facilitated because the first-position pawl 13 no longer exerts a moment of inertia on the blocking lever 8. The movement of the tip 6*b* or the primary-position pawl 6, which is responsible for moving the arm 8*b* away from the pin 14, is then caused by the catch, which rotates toward the open position, wherein the lateral contour area 4*a* presses against the then-adjacent lateral contour area of the hook 6*b*. As shown, the end portion 4*b* of the contour area 4*a* is angled or bent outwards (as seen from the catch) in order to rotate the primary-position pawl, and thereby to rotate the hook 6*b*, particularly toward the outside along the arrow 16. As a result of this rotation, the lever arm 8*b* is moved particularly far away from the stop 14, and a desirable bias is then provided by the spring 10. Advantageously, the tip of the hook 6*b* is longer than the tip of the hook 8*a* in order to provide a particularly large tension of the spring 10. Because the hook 8*a* does not have to achieve such an effect, the hook 8*a* is relatively short. All of this ensures a particularly reliable operation.

If the catch is rotated from the open position toward the closed position up to the first position, the first-position pawl then snaps into its locked position, wherein the first-position pawl is then rotated opposite to the direction of the arrow 16 until a further rotation is limited by the stop 20, as shown in FIG. 1. In this first position, the corresponding lateral contour section of the hook 6*b* still lies against the lateral contour area 4*a*. This blocks the rotation of the blocking lever 8 such that the arm 8*b* is moved in the direction of the arrow 11. The bias of the spring 10 is then further increased in a desired manner. When the lateral contour portion 4*a*, which extends from the corner point 4*b* to the corner point 4*c*, ultimately sets free the primary-position pawl 6, a high biasing force is provided in order to reliably move the primary-position pawl into the locked position when the corresponding vehicle door or hatch is closed.

To rotate the first-position pawl out of its locked position, in order to unlock the lock, the first-position pawl is stricken at the grip area 21 and rotated. The striking and rotating of the first-position pawl 13 can be done manually or with the help of a motor. Since the first-position pawl can also be rotated backwards by a motor, a spring that biases the first-position pawl in the locked position is not mandatory. For performance and safety reasons is, however, the provision of such a spring beneficial.

The previously described characteristics of the exemplary embodiment can be applied individually or in combination to the inventive lock.

Figure 2:
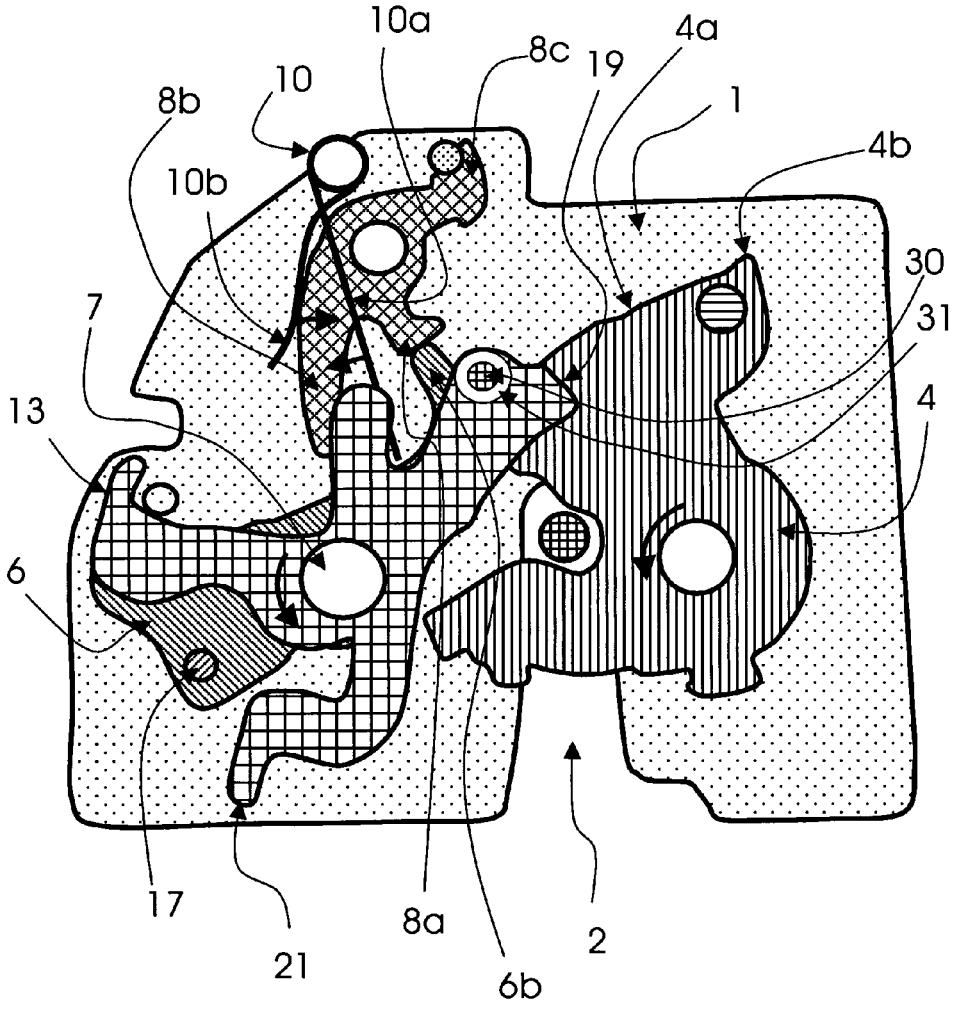
FIG. 2 shows the closed position of the lock of FIG. 1.

FIG. 2 shows the lock of FIG. 1. However, the first-position pawl 13 is not shown as transparent in this figure. Therefore, the first-position pawl 13 partially covers inter alia the primary-position pawl 6. FIG. 2 illustrates that a protruding pin 30, projecting upward as seen from the housing wall 1, is disposed on the first-position pawl. This pin is made of metal and a plastic sleeve is disposed around it. The pin 30 with the sleeve 31 carries a bracket not shown in FIG. 2. The plastic reduces friction and associated noise when the bracket is moved.

Figure 3:
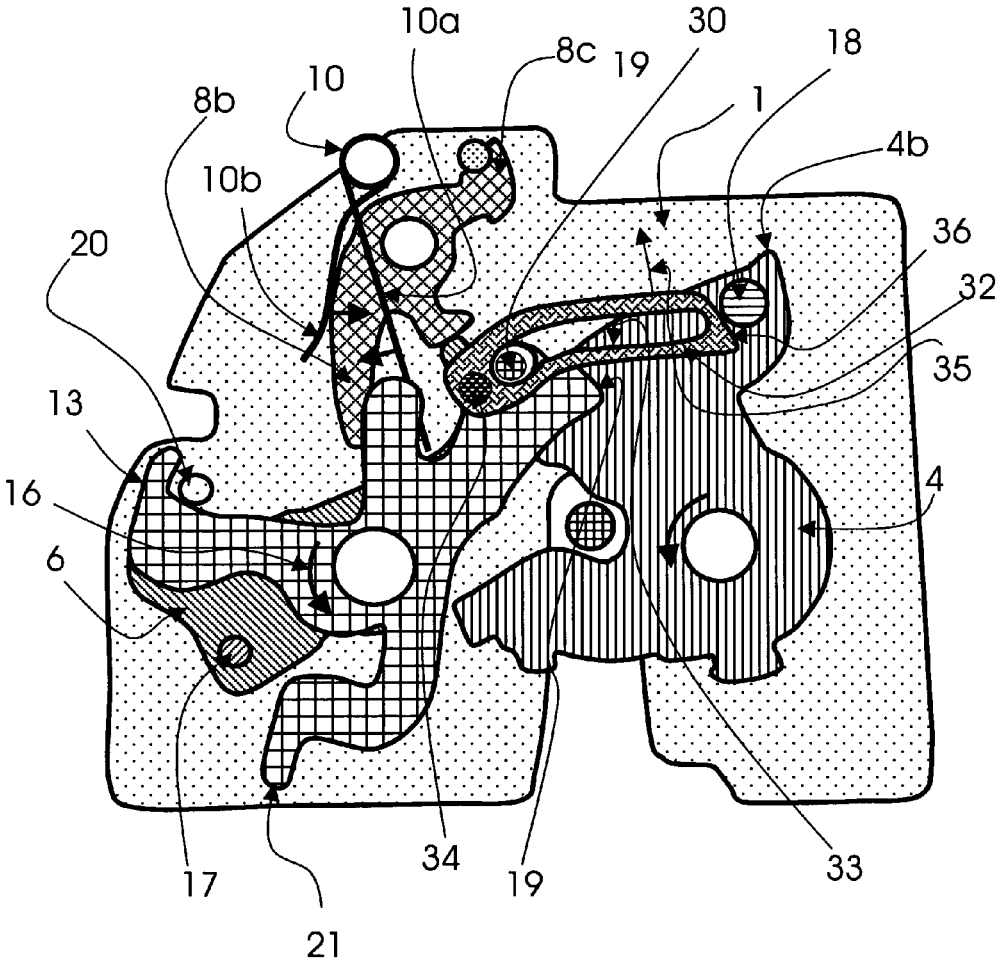
FIG. 3 shows the lock of FIG. 1 with a bracket for moving the catch.

FIG. 3, as compared to FIG. 2, additionally shows the bracket 32, which is located above the first-position pawl 13. The bracket is provided with a slot 33, into which the projecting pin 30 of the first-position pawl reaches. The bracket 32 is steered and guided by means of the slot 33 and the pin 30. The bracket can be moved back and forth between an initial position and an end position, as shown in FIG. 3. The end position is reached when the catch 4 is turned from the first position to the primary position through the movement of the bracket 32 from the initial position to the end position.

To move the bracket by means of a motor, the bracket comprises a pin 34 that projects upward. The pin 34 extends into a hole of a lever that is disposed above it. The lever can in turn be rotated about an axis. While the lever is rotated about its axis by means of a motor, the bracket is moved between the initial position and the end position. However, when the first-position pawl is rotated in the direction of the arrow 16 by actuating of a door handle connected thereto, the bracket pivots upward in the direction of the arrow 35. In this way, the bracket loses contact with the pin 18 of the catch, which pin serves as a stop. A forward movement of the bracket toward the end position, then, no longer results in the rotation of the catch 4 toward the direction of the primary position. Instead, the catch is released and can rotate back into the open position.

The slot 33 extends as shown partly in a curved manner such that it and the corresponding end bracket 36 (which is adjacent to the stop 18) eventually follow the rotational movement of the catch and the rotation of the stop 18 associated therewith.

If the catch is locked in the first position by the first-position pawl 13, wherein the pin 18 pushes against the lateral contour portion 19 of the first-position pawl and in this way prevents the rotation of the catch toward the open position, the aforementioned bracket end 36 initially has, advantageously, a small distance to the pin 18, e.g., 1 to 3 mm, so as not to impair the locking of the catch. When the bracket is subsequently driven from the initial position by means of a motor, the bracket reaches the stop 18, then presses the stop 18 toward the primary position while the first-position pawl is not moved. The first-position pawl will generally not move at this time because it is biased, presses against the stop 20, and remains in this position.

Figure 4:
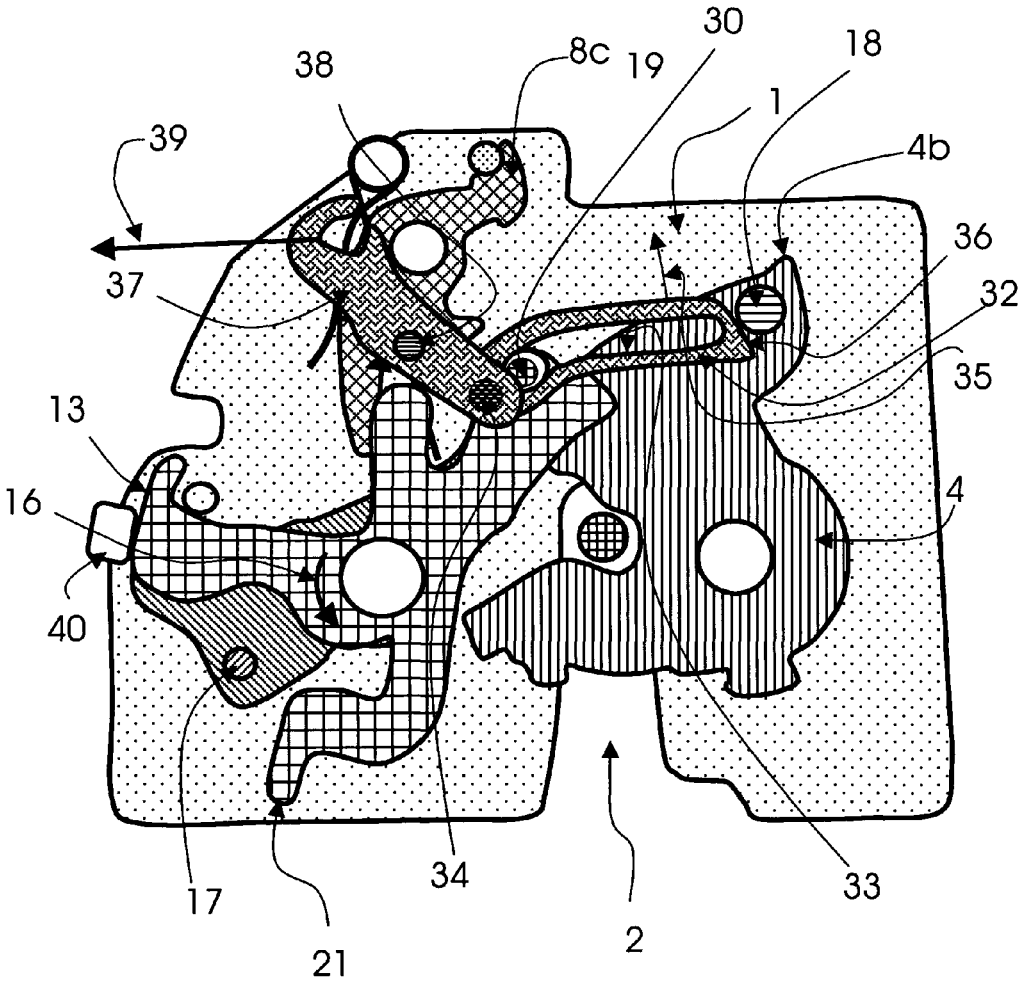
FIG. 4 shows the lock of FIG. 1 with the microswitches.

FIG. 4, as compared with FIG. 3, additionally shows the lever 37, which is mounted rotatably about the axis 38. The lever 37 is rotated counterclockwise about its rotational axis 38 by pulling of the cable 39 in the direction of the arrow and, thereby, the associated bracket is rotated, as described above, from its initial position to its final position. The pin 34, which reaches into a corresponding hole of the lever 37, projects also advantageously out of this hole upwards, and is then disposed between two stops (not shown) in order to appropriately limit the movement of the bracket and the movement of the lever. The stops are designed to limit excessive forces that act on parts of the locking mechanism, which could otherwise damage it.

The cable 39 is attached to the end of the longer lever arm of the lever 37, as seen from the axis of rotation 38, as compared to the other shorter lever arm with a hole into which at least the pin 34 extends. In this way, the motor force that pulls on the cable 39 is amplified according to the lever rule. It is, therefore, sufficient to use a relatively small motor force to rotate the catch from the first position to the primary position. The cable 39 is hooked into a designated hook of the lever 37.

The lever 37 is advantageously biased in the direction toward the starting position such that the lever 37, and thereby also the bracket 35, can pivot on their own back to their initial positions, even when the motor drive should fail. Therefore, a malfunction of the motor does not result in a malfunction of the lock.

As shown in FIG. 4, in one embodiment of the invention, a microswitch 40 is advantageously located adjacent to the corresponding lateral contour areas of the first-position pawl and/or the primary-position pawl, depending on the positions of the affected pawls. The positions of each pawl can then be read by the microswitch. If it is determined by means of the microswitch, for example, that the first-position pawl has reached the stop 20 but that the primary-position pawl is not yet present in its locked position, then the motor is set in motion to pull on the cable 39. The drive motor is stopped as soon as another microswitch determines that the primary-position pawl has snapped into its locked position.

Shoe-shaped lever arms, as shown in the figures, are useful for determining at any time the position of the corresponding pawls, with the help of microswitches and with minimal use of materials. These lever arms are useful for controlling the movement of the parts of the lock.

If the bias of the lever 37 is chosen to be appropriately strong, in a certain embodiment of the invention, the spring force turns the lever 37 back into its initial position after the motor drive has stopped.

The invention claimed is:

1. A lock for a motor vehicle with a locking mechanism comprising a catch, a primary position pawl, a first position pawl that rotates about a common axis with the primary position pawl, and a bracket, wherein said catch can be locked in a first position and a primary position, wherein said catch further comprises a protruding stop, wherein said catch can be rotated from said first position into said primary position by moving said bracket by means of a motor drive, the bracket pressing against the protruding stop to move the catch toward the primary position, and wherein said stop functions as a stop for said first position pawl by contacting a surface of said first position pawl in the first position, thereby locking the catch in the first position.

2. The lock of claim 1, wherein said bracket is disposed in a plane above said first-position pawl on an opposite side of the first position pawl relative to the primary position pawl.

3. The lock of claim 2, further comprising a guide which controls a movement of said bracket relative to said first-position pawl.

4. The lock of claim 1, wherein said bracket is initially movable in a straight line starting from a starting position and is subsequently movable on a curve corresponding to a movement of said catch into a final position.

5. The lock of claim 1, wherein said bracket is controlled via a slot (33) into which a first pin (30) of said first-position pawl extends.

6. The lock of claim 5, wherein said bracket comprises a second pin that projects upwards, which second pin extends upward into a hole of a first lever in a plane above the bracket, and which second pin can be moved by a motor.

7. The lock of claim 6, wherein a motor actuates a long, second lever, which is longer compared to said first lever comprising a hole into which said second pin extends.

8. The lock of claim 1, wherein said bracket has a distance to its stop when said catch is locked in said first position.

9. The lock of claim 1, wherein said bracket can be moved from its initial position to its final position by means of a cable.

10. The lock of claim 1, wherein said bracket can be moved from its initial position to its final position by a biasing force.

11. The lock of claim 1, wherein said bracket can be moved from its initial position to its final position by a first lever which is biased.

12. The lock of claim 1 comprising control means, wherein said control means function to move said bracket in the direction toward its final position by means of a motor, when said first-position pawl is in its locked position and when said primary-position pawl is not in its locked position.

13. The lock of claim 12, wherein said control means are micro switches for determining positions of said pawls.

14. The lock of claim 13, wherein said micro switches abut shoe-shaped lever arms of said pawls in certain positions of said pawls.

* * * * *